United States Patent [19]

Steel

[11] 3,964,671

[45] June 22, 1976

[54] CARTON FOR A PACKAGE CONVERTIBLE TO A BAKING PAN

[75] Inventor: Thomas C. Steel, Oak Brook Terrace, Ill.

[73] Assignee: Federal Paper Board Company, Inc., Montvale, N.J.

[22] Filed: May 12, 1975

[21] Appl. No.: 576,888

[52] U.S. Cl. ..... 229/51 TS

[51] Int. Cl.[2] ..... B65D 5/54; B65D 5/48

[58] Field of Search ..... 229/51 TS, 51 D, 51 TC, 229/17

[56] References Cited

UNITED STATES PATENTS

| | | | |
|---|---|---|---|
| 2,751,136 | 6/1956 | Moore | 229/51 TC X |
| 3,043,472 | 7/1962 | Nemode | 229/51 TS UX |
| 3,301,391 | 1/1967 | Guyer | 229/51 TC X |
| 3,309,005 | 3/1967 | Pilger | 229/51 TS |
| 3,315,875 | 4/1967 | Praetorius | 229/51 TS |
| 3,458,109 | 7/1969 | Compton et al. | 229/51 TS X |
| 3,491,937 | 1/1970 | Brastad | 229/51 TC |
| 3,854,652 | 12/1974 | Brackman | 229/51 D X |

*Primary Examiner*—Davis T. Moorhead
*Attorney, Agent, or Firm*—Guy A. Greenawalt

[57] ABSTRACT

A carton and a package especially adapted for use in marketing ingredients for a bakery product, the carton being formed from a single blank to provide, when opened up, a tubular container with end closure flaps which are adapted to be closed and sealed at one end to enable filling through the opposite end, after which the flaps at the filling end are closed and sealed, and the top wall forming panel being provided with spaced, parallel, cut scores forming tear lines so that outermost end flaps may be pulled loose and a substantial portion of the top wall panel may be separated on the tear lines and discarded with the end flaps, resulting in conversion of the container to an open top tray which may be used as a baking pan or baking tray for processing the ingredients in a conventional baking oven.

2 Claims, 5 Drawing Figures

FIG. 1
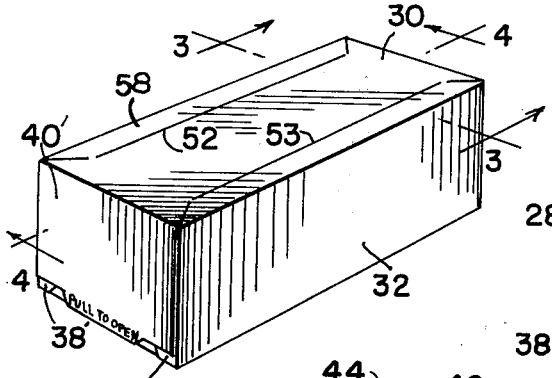
FIG. 3
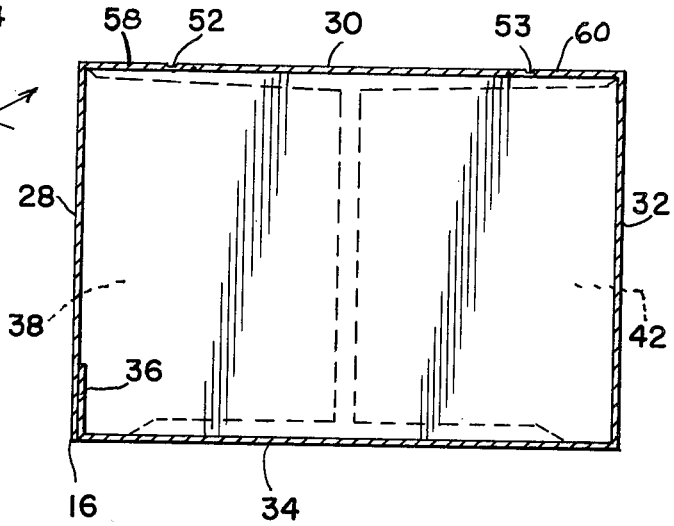
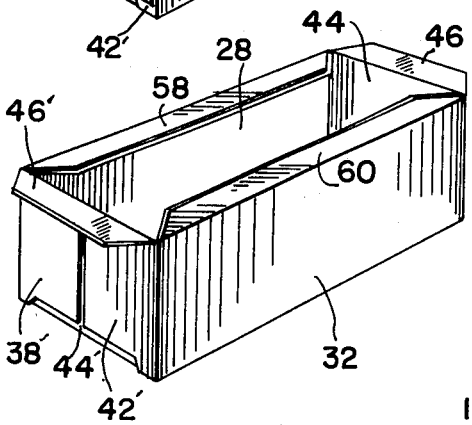
FIG. 2
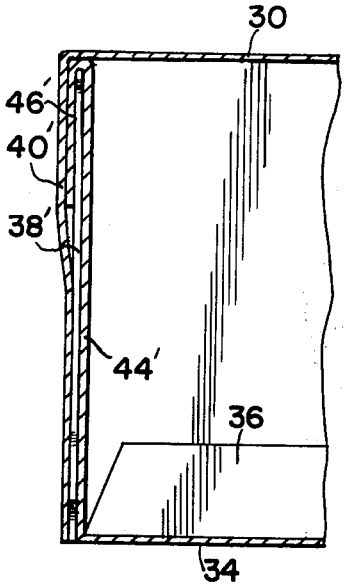
FIG. 4
FIG. 5
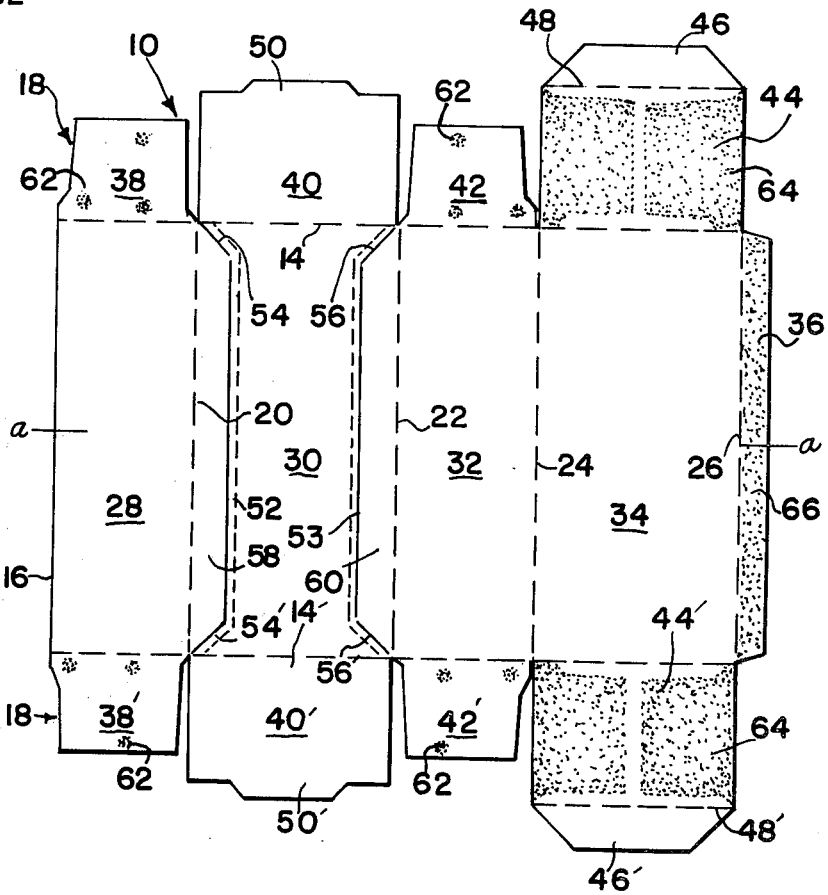

CARTON FOR A PACKAGE CONVERTIBLE TO A BAKING PAN

This invention relates to packaging and the manufacture of containers for packaging various products and is more particularly concerned with improvements in containers and packages which are especially adapted for use in the marketing of products which are intended for further processing in an oven, such as, bakery products.

Numerous so-called convenience packages have been designed for marketing various products, many of which products are prepared and in frozen condition and are intended to be heated in an oven for immediate use or for further processing. In most of such packages, the packaging material is a thin metal material, such as, metal foil of sufficient thickness or gauge to hold the desired package shape, with a removable cover sheet which may be of the same or other suitable material. While some packages of this type employing paperboard or paperboard laminated with foil, or other materials, have been designed they have not been used to the fullest extent possible due to the cost of the materials, the need for especially designed packaging and handling equipment or for other reasons. Generally, such packages have not been designed for and have not been considered suitable for marketing loose dry materials, such as, flour and other dry or dried material of the type employed in making a dry mix for bakery products to which liquid must be added for processing in an oven. Experience with prior developed packaging procedures and a revival of interest in home baking operations has prompted suppliers of packaging materials for this purpose and for other products of somewhat similar character to seek improved packaging procedures for supplying the products in packages in the most convenient form for use. It is a general object of the invention, therefore, to provide a package and a packaging procedure for this and other type products which is economical with respect to material and labor and which enables the product to be supplied for use in the most convenient manner.

It is a more specific object of the invention to provide package components particularly adapted for packaging a product, such as, for example, the ingredients for bread which is to be produced or processed by heating in an oven, which package may be formed of relatively low cost material and the packaging accomplished on standard packaging machinery with little modification, with the package being in a form which is most convenient for use by the consumer.

It is another object of the invention to provide a packaging container which may be formed of a single blank of paperboard stock or similar foldable or formable sheet material, including a laminated or coated material, so as to enable it to be used for packaging a product which may be, for example, in powder or granular form, with provision for readily removing outer portions of the end walls together with a substantial portion of the top wall so as to convert the container to an open top or partially open top tray in which the product may remain for further treatment or processing, such as, for example, heating in an oven.

To this end the invention as claimed herein is embodied in a package which employs a product container or carton formed from a single blank of foldable sheet or web material which is cut and scored to provide a series of connected side wall forming panels and end wall forming closure panels which are hinged to opposite ends of the side wall panels and which are folded and sealed so as to bring the end wall panels which are hinged to opposite ends of the top side wall onto the outermost faces of the end wall structures, and the top side wall panel having parallel tear line formations which are in laterally spaced relation and which extend between the hinge connections of the end wall panels with the top side wall panel so that the outer end wall panels may be separated from the associated end wall panels and a substantial portion of the top wall panel removed by tearing on the tear lines thereby enabling the torn out portion to be discarded along with the associated end wall panels so as to convert the container to an open top tray, providing access of the contents, and in which the product may be retained and submitted to processing, such as, for example, heating in an oven.

The aforesaid objects and other objects and advantages will become more apparent when reference is made to the accompanying detailed description of the preferred embodiments of the invention which are set forth therein, by way of example, and shown in the accompanying drawings wherein like reference numerals indicate corresponding parts throughout.

FIG. 1 is a perspective view of a completed package made according to the present invention;

FIG. 2 is a perspective view of the package of FIG. 1 when it has been opened by removing a portion of the top wall forming panel and the attached outer end wall panels;

FIG. 3 is a cross sectional view taken on the line 3—3 of FIG. 1, to an enlarged scale;

FIG. 4 is a cross sectional view taken on the line 4—4 of FIG. 1; and FIG. 5 is a plan view of a blank of carton forming sheet material cut and creased for fabricating the carton employed in forming the package of FIG. 1.

While it will be understood that the principles of the present invention may be otherwise applied, a description of the invention will be made herewith by reference to certain preferred embodiments wherein a container or carton structure is provided which is especially adapted for the packaging of a product which is in the form of ingredients for the making of a bakery product, such as, bread of various kinds, which may be retained in the container when it is opened into the form of an open top tray, providing access to the contents and enabling it to be placed in an oven for baking, with the open container serving as a baking pan.

Referring first to FIG. 5 of the drawings, there is illustrated a blank 10 of container forming material which is cut and scored preparatory to the fabrication of the carton structure embodied in the package 12 of FIG. 1. The blank 10 is taken from paperboard sheet or web stock, of suitable weight, which has been coated with a film forming material which is heat resistant to a degree sufficient to withstand normal baking oven temperatures for bread and similar products. The paperboard may be coated, for example, by extruding thereon a film of a polyester base material.

The blank 10 which is cut and scored as shown in FIG. 5 is symmetrical about the longitudinal center line *a—a*. It is divided by hinge forming, parallel score lines 14 and 14', which are transversely spaced and which extend longitudinally of the blank, into a central body section 16 and side sections 18 and 18'. The center section 16 is subdivided by parallel, longitudinally spaced, transverse score lines 20, 22, 24 and 26 into connected side wall forming panels 28, 30, 32, 34 and a connecting glue panel 36, the latter being at one end of the blank. The blank side sections 18 and 18' are divided into a series of end wall forming panels or flaps 38, 40, 42, 44 and 38', 40', 42', 44' by cuts or slots extending transversely of the blank from opposite ends of the transverse score lines 20, 22 and 24. In the form shown the separating slots result in end wall forming panels 38, 38' and 42, 42' which are of somewhat smaller dimension in the lengthwise direction of the blank than the respective side wall forming panels from which they extend so as to eliminate interference between the end wall panels during folding operations. The end wall panels 44 and 44'have narrow flange forming panels or tuck flaps 46, 46' extending along the outer side edge margins of the blank which are separated from the closure forming portions of the panels 44, 44' by longitudinal score lines 48, 48'while the end wall panels 40, 40' are cut along the free outer edges so as to form finger gripping tab members 50, 50'. The over-all transverse dimension of the panels 40, 40' corresponds approximately to the dimension of the panels 28 and 32 in the direction longitudinally of the blank. The dimension of the panels 44, 44' between the hinge lines 14, 48 and 14', 48' corresponds to the dimension of the panels 28 and 32 in the direction longitudinally of the blank. The one side wall panel 30 which is designed to serve as a top side wall of the container is provided with cut scores defining tear line formations 52, 53 extending transversely of the blank, the major portion of each of which is spaced from the associated hinge forming score line 20 and 22, with diagonal lines 54, 54' and 56, 56' extending from opposite ends thereof to the ends of the associated transverse score lines 20 and 22 as shown in FIG. 5. As indicated in the drawings, the tear line formations preferably comprise cut score lines on the inside and on the outside faces of the panel which penetrate part way through the material and which are offset so as to insure straight line tearing.

In forming the package 12, which may be accomplished on standard or conventional carton forming equipment, the cut and scored blank 10 is folded on the transverse score lines 20 and 24 so as to bring the margin of panel 28 into engagement with the outside face of the connecting panel or flap member 36, the latter having an adhesive applied thereon so as to effect a sealed connection. The collapsed carton in tubular form may be supplied to the packer where it is opened up into a tube, one end is closed and sealed, and the carton is filled from the opposite end, after which that end is closed and sealed. The setting up, closing and sealing one end, filling, and final closing and sealing the opposite end may be accomplished on standard end seal carton handling equipment with relatively slight modification for handling the closing and sealing sequence of the end flaps or panels. When desirable, the product being packaged, for example, bread making ingredients, may be enclosed in an inner bag. The proper closing sequence involves closing first the end panels 44, 44' followed by folding and gluing the panels 38, 42 and 38', 42', the tucking flaps 46, 46' being folded back over the top margins of the panels 38, 42 and 38', 42', so as to stiffen the panels 44, 44', and finally folding the outermost panels 40 and 40' with spot glue or similar sealing so that these panels may be torn loose without disturbing or destroying the underlying end panels. The application of an adhesive is indicated in FIG. 5 at 62 on the end panels 38, 42, 38', 42' and at 64 on the end panels 44, 44'. An adhesive is also indicated at 66 on glue flap 36.

In opening the package 12 the tab members 50 and 50' may be gripped and pulled upwardly to release the panels 40 and 40' after which the portion 56 (FIG. 1) of the top wall panel 30 which extends between the tear lines 52 and 54 may be torn loose and discarded along with the outer end panels 40, 40', leaving an open top package, as shown in FIG. 2, with the carton or container in the form of a tray having top edge flanges 58, 60 and 46, 46' which are of relatively narrow width. The flange-like portions 58, 60 of the top wall, which remain, may be hinged to any desired position and will reinforce and stiffen the side wall edges to which they are attached so as to reduce any bulging resulting from pressure of the contents. Preferably, they will be hinged outwardly and restrict outward bowing of the side walls. The tuck flaps 46, 46' on the inner end wall panels which will tend to spring upward to the plane of the top wall when released by removal of the panels 40, 40' serve the same purpose. The latter may, however, be omitted where there is sufficient stiffness in the end walls without the flaps.

While specific materials for the carton are recited, it will be understood that other materials suitable for the purpose may be used. Also, the use of the carton is not limited to the specific products referred to. It may be found useful in the packaging of a variety of other products, for example, frozen foods of various kinds.

I claim:

1. A carton for packaging a product, said carton being initially formed as a tube comprising top, bottom and connecting side wall panels, each with oppositely disposed end edges, end closure panels hingedly connected to said top, bottom and side wall panel end edges, which end closure panels are foldable to closed position so as to form an end wall structure, the end closure panels which are connected to said top side wall panel being secured in overlying relation to end closure panels which are connected to adjoining side wall panels and being secured to the underlying panels by means which enables at least a middle portion thereof to be readily torn loose without destroying the end wall structure, and said top wall forming panel having laterally spaced tear line formations which are disposed in spaced, parallel relation to the side edges of the top wall forming panel and which extend between the associated end wall panels, whereby the outermost end wall panels and a major portion of the top wall forming panel may be torn loose and discarded so as to convert the carton to an open top tray structure having narrow flange formations hinged to the top edges of the side walls which serve to reinforce the top edges of the side wall panels, and said end wall forming closure panels which are hingedly connected to said bottom wall panel having tuck flaps on the margin opposite their hinged connection with said bottom wall panel which serve as top edge flanges and reinforce the top edges of the end wall panels when said major portion of said top wall forming panel is torn loose and pulled free of said top wall forming panel.

2. A blank for forming a carton comprising an elongate sheet of foldable carton forming material which is divided by laterally spaced, longitudinal score lines and longitudinally spaced, parallel, transverse score lines into a series of connected top, bottom and side wall forming panels which are adapted to be folded and connected to form a tube, and end closure panels which extend outwardly along opposite side margins of the blank and are separated from each other by slots which are cut in the blank so as to be aligned with said transverse score lines and which extend to the longitudinal score lines, said end closure panels being adapted to be folded into tube end closing relation and said top side wall forming panel having tear line formations which are spaced from the transverse score lines defining said top side wall panel and which extend between the end closure panels on said top side wall panel in diverging relation at the ends thereof to the inner ends of said panel separating slots thereby enabling said end wall forming panels which extend from said top wall forming panel and the major portion of said top wall forming panel to be readily torn out when the blank is formed into a set up and closed carton structure so as to open the carton and convert the same to an open top tray with narrow flange formations extending along the top edges of the side wall forming panels.

* * * * *